US005323216A

United States Patent [19]

Mahoney

[11] Patent Number: 5,323,216

[45] Date of Patent: Jun. 21, 1994

[54] LATERAL MOVING FUSER STATION

[75] Inventor: Gregory P. Mahoney, Fairport, N.Y.

[73] Assignee: Eastman Kodak Company, Rochester, N.Y.

[21] Appl. No.: 873,866

[22] Filed: Apr. 27, 1992

[51] Int. Cl.[5] ..... G03G 15/20

[52] U.S. Cl. ..... 355/285; 219/216; 355/208; 355/290; 355/311

[58] Field of Search ..... 355/282, 285, 290, 295, 355/311, 208; 219/216, 469–470; 432/60; 118/60

[56] References Cited

U.S. PATENT DOCUMENTS

| | | | |
|---|---|---|---|
| 3,856,461 | 12/1974 | Jordan | 432/60 |
| 3,856,462 | 12/1974 | Mueller | 432/60 |
| 4,110,068 | 8/1978 | Brown et al. | 432/60 |
| 4,305,330 | 12/1981 | Ogihara | 100/35 |
| 4,565,439 | 1/1986 | Reynolds | 355/290 |
| 4,566,778 | 1/1986 | Sasaki | 355/295 |
| 4,789,877 | 12/1988 | Izaki | 219/216 X |
| 4,825,242 | 4/1989 | Elter | 355/285 X |
| 4,905,051 | 2/1990 | Satoh et al. | 355/282 |
| 4,972,232 | 11/1990 | Hoover et al. | 355/282 X |
| 5,153,655 | 10/1992 | Suzuki et al. | 355/285 |
| 5,196,895 | 3/1993 | Setoriyama et al. | 355/285 |

OTHER PUBLICATIONS

Research Disclosure #13963; High Frequency Vibrating Blade Cleaner; Nov. 1975; Xerox Corporation.

*Primary Examiner*—A. T. Grimley
*Assistant Examiner*—Shuk Y. Lee
*Attorney, Agent, or Firm*—J. Gary Mohr

[57] ABSTRACT

In a reproduction apparatus, such as a copier, having a fusing station which includes a heated coated fuser roller and a pressure roller forming a nip for fusing a receiver passing through said nip, the fusing station is mounted for lateral movement in relation to the movement of the receiver through the nip.

1 Claim, 2 Drawing Sheets

LATERAL MOVING FUSER STATION

FIELD OF THE INVENTION

The present invention generally relates to a fusing device used in reproduction apparatus for fixing a toner image to a receiver, such as a sheet of copy paper. More specifically, the present invention relates to a fusing device which is movable in a lateral direction to reduce or eliminate fuser roller defects, such as swelling, stepping and grooving.

BACKGROUND OF THE INVENTION

Generally, a fusing unit for fixing toner images in a reproduction apparatus has a heated fuser roller. The fuser roller is of cylindrical shape with a metallic core over which is formed an elastomeric layer. The elastomeric layer of the fuser roller makes contact with a pressure roller to form a fusing nip through which a receiver, carrying the toner images is passed to fuse the toner images to the receiver. This type fusing unit is known to have high thermal efficiency with minimal danger of causing a fire if receiver jamming occurs. A problem, however, with this type of fusing unit is the elastomeric layer has a tendance to swell, step or groove over a period of use, typically in the range of 100,000 or more copies, resulting in wrinkling or other unacceptable fusing performance. This swelling and grooving occurs at the portion of the fuser roller near the ends of the receiver and outward therefrom where the fuser roller is not protected, during fusing, from the pressure roller by the presence of the receiver between the fuser roller and the pressure roller. Accordingly, in such end portions of the fuser roller, high stresses are created between the directly contacting surfaces of the fuser roller with the pressure roller. As a net result, the thin outer layer or coating, of the fuser roller, in the unprotected area tends to fail. This failure is hastened by continued use of the same width receiver or large volume runs of the same width receiver constantly moving across the same area of the fuser roller.

SUMMARY OF THE INVENTION

It is an object of the present invention to provide a fusing station that minimizes swelling, stepping or grooving of the fuser roller.

The above object is accomplished by a fusing station installable in a reproduction apparatus for fusing a toner image to a receiver as the receiver moves through a nip formed by rotating rollers, the fusing station comprising:

means for mounting the rollers in rotational and pressure contact with each other;

means for laterally moving at least one of the rollers relative to the movement of the receiver through the nip;

guide means for guiding the lateral movement of at least one of the rollers relative to the movement of the receiver through the nip;

drive means for imparting lateral movement to at least one of the rollers; and means for controlling the activation and de-activation of the drive means.

The invention, and its objects and advantages, will become more apparent in the detailed description of the preferred embodiment presented below.

DESCRIPTION OF THE PREFERRED EMBODIMENT

Figure 1:
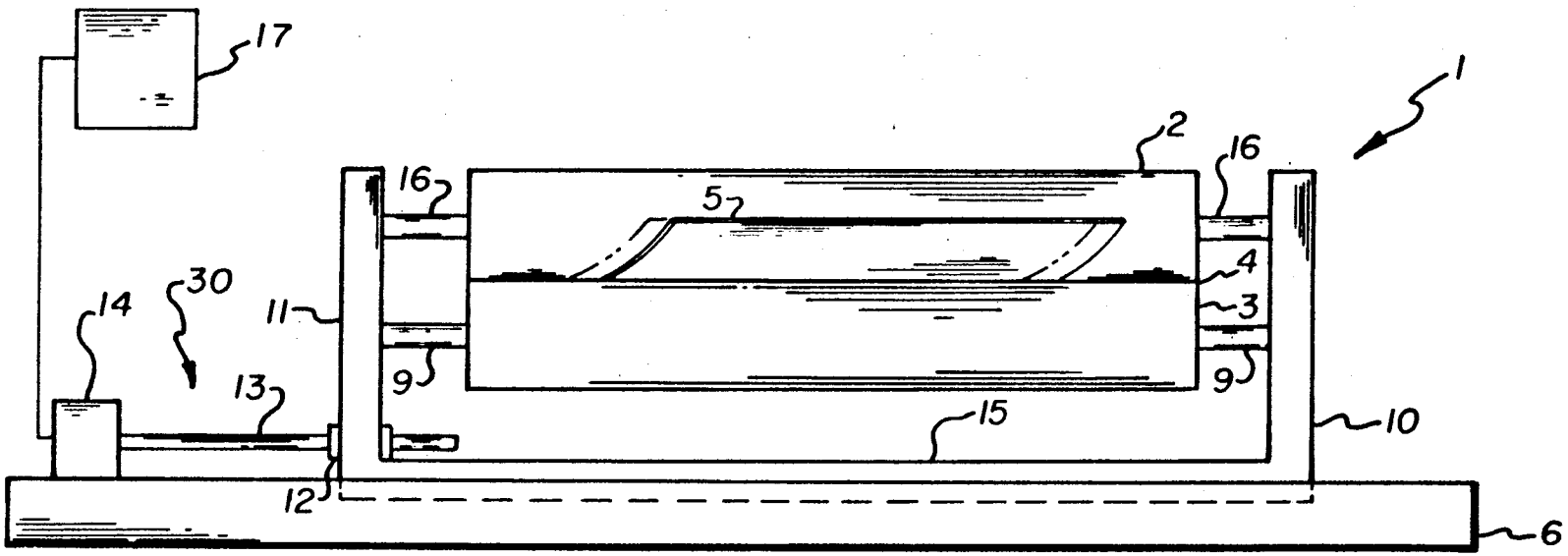
FIG. 1 is a schematic front view of the fuser station in accordance with the present invention.

In describing the preferred embodiment of the present invention, reference is made to the drawings, wherein like numerals indicate like parts and structural features in the various views, diagrams and drawings.

While this invention is susceptible of embodiment in many different forms, there are shown in the drawings and will herein be described, in detail, a preferred embodiment of the invention. It should be understood, however, that the present disclosure is to be considered as an exemplification of the principles of the invention and is not intended to limit the invention to the embodiments illustrated and/or described.

The precise shapes and sizes of the components herein described are not essential to the invention unless otherwise indicated, since the invention is described with only reference to an embodiment which is simple and straightforward.

For ease of description, the apparatus will be described in a normal operation position, and terms such as upper, lower, horizontal, etc. . . . , will be used with reference to this normal operation position. It will be understood, however, that this apparatus may be manufactured, stored, transported and sold in an orientation other than the normal operation position described.

Much of the apparatus disclosed herein has certain conventional drive and control mechanisms the details of which, though not fully illustrated or described, will be apparent to those having skill in the art and an understanding of the necessary functions of such drive mechanisms.

Referring now to FIG. 1 a fusing station 1 is provided of the type having a pressure roller 2 and a heated fuser roller 3, in pressure contact with each other, to form a fusing nip 4. A receiver 5, carrying an image to be fused, is delivered to fusing nip 4, by a series of transport rollers 26, see FIG. 2, subsequent to receiver 5 leaving a typical transfer station, of a reproduction apparatus, not shown, but known in the art.

Figure 2:
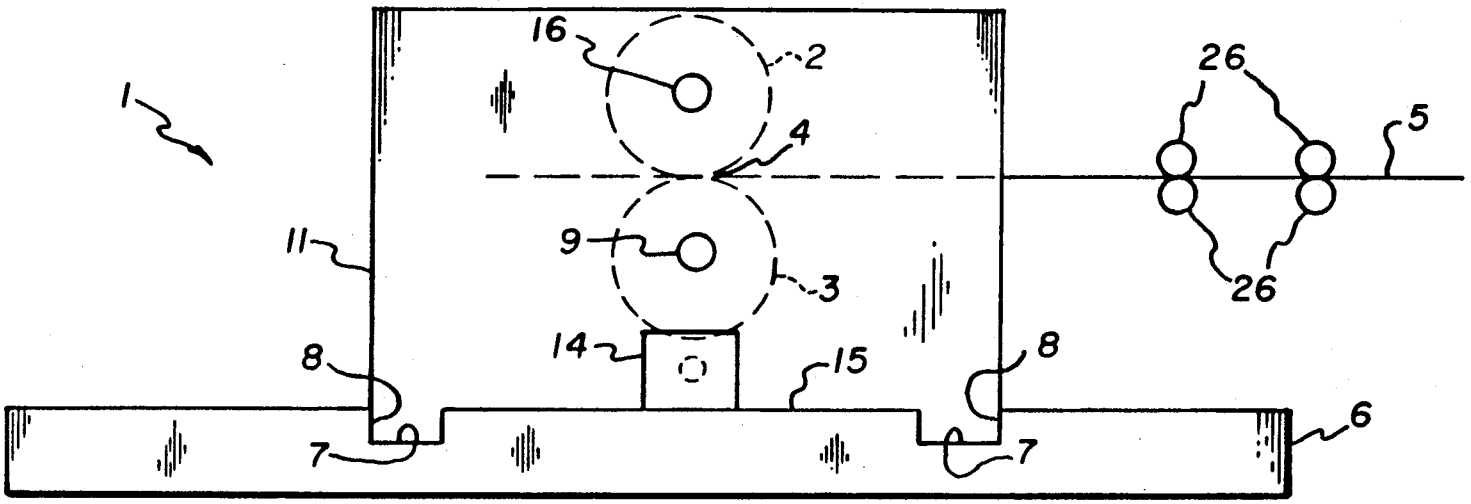
FIG. 2 is a schematic side view of the fuser station in accordance with the present invention.

Fusing station 1 is mounted, on a stationary base plate 6, of the reproduction apparatus, for lateral movement, of fusing station 1, relative to the direction of travel of receiver 5 through nip 4. As shown in FIG. 2, stationary base plate 6 has two grooves 7. Tracks 8 located on bottom plate 15, of fusing station 1, are inserted into grooves 7 so that the lateral movement of fusing station 1 over base plate 6 is parallel to fusing nip 4, thereby preventing fusing station 1 from becoming skewed relative to receiver 5. While a track and groove system has been shown and described for guiding the lateral movement of fusing station 1, other methods of guiding lateral movement, which are known in the art, but not shown, such as roller slides may be used to guide the lateral movement of fusing station 1.

As shown in FIG. 1, shaft 16 of fuser roller 3 and shaft 9 of pressure roller 2 are mounted for rotational movement within a bracket system containing roller brackets 10 and 11 secured to bottom plate 15. Connected to roller bracket 11 is a drive linkage 30, such as a lead screw/nut linkage. A nut 12, of lead screw/nut linkage 30, is located within or attached to bracket 11. One end of a lead screw 13 is in threaded mating contact with nut 12 and the other end of lead screw 13 is connected to a motor 14. Lead screw/nut linkage 30 converts the rotation output of motor 14 into a linear drive that moves fusing station 1, within guide grooves 7, laterally over stationary plate 6. While the above description and drawings portray a lead screw/nut drive system, other drive systems, known in the art, but not shown, for imparting linear motion, such as a crank and slider system, cam drive, belt drive, cable drive or a chain drive system may be used to impart lateral movement to fusing station 1.

To activate and deactivate motor 14, connected to lead screw/nut linkage 30, and thereby impart or cease lateral drive to fusing station 1, a logic and control circuit 17, known in the art, is connected to motor 14. Logic and control circuit 17 is also connected to a receiver sensing device, typically located in a receiver supply tray, which is known in the art, but not shown, that senses the size of receiver 5 to be used in a copying cycle. Logic and control unit 17 is further connected to an operator control panel, known in the art, but not shown, so when the number of copies to be run is selected on the operator control panel, that information may be conveyed to logic and control circuit 17. Logic and control circuit 17, upon receipt of the information from the receiver sensor device and the control panel, compares the information received to a known number. The known number being a representation of the ideal volume for the size receiver that is to be run, through a specified area of nip 4, without risk of fuser roller 3 swelling or grooving. Depending on the results of the comparison, control and logic circuit 17 either activates motor 14, prior to the start of the copy cycle, for a set interval of time, to laterally move fuser station 1 a preset distance or maintains motor 14 deactivated and fuser system 1 in a stationary position relative to stationary base plate 6. When comparisons such as the above are capable of being made, by a logic and control circuit, prior to logic and control circuit 17 activating motor 14, such a logic and control circuit is considered, in the art, a smart system. As opposed to using the smart system, above described, logic and control circuit 17 may be programmed to activate motor 14, after a pre-set volume of copies have been fused, say every 10,000, to laterally move fusing station 1. This activation after every 10,000 copies, while normally resulting in fusing station 1 moving more often, has the same end results as with the smart system, in that receiver 5 is not always fused in the same area of fuser roller 3.

The activation, of motor 14, for a pre-set period of time, by either of the above described methods, causes lead screw 13 to rotate and laterally drive fuser station 1, a pre-set distance, toward or away from motor 14. While this lateral movement, of fusing station 1, may be preformed at any time, the comparison by logic and control circuit 17, of information regarding the size of receiver 5 and the amount of receiver 5 to be run, or the monitoring of the total amount of copies run since the last lateral movement of fusing station 1, is preferably performed before each receiver 5 copy cycle. Depending on the outcome of the comparison or the tally of copies already run, motor 14 may or may not be activated, for a period of time, to provide lateral movement to fusing station 1. By performing the comparison or copy run count prior to each receiver 5 copy cycle and restricting lateral movement of fusing station 1, to either between copy runs or during interframes, this avoids adverse effects in the fusing process, that could result from movement of fusing station 1 while receiver 5 is in fusing nip 4.

FIG. 1 illustrates the effects of such lateral movement. If the lateral movement of fusing station 1, is away from motor 14, such lateral movement causes receiver 5, which during the last copy cycle was fused in the area where receiver 5 is shown in solid lines, to now be fused in the area where receiver 5 is shown in dotted lines. As a result of this lateral movement of fusing station 1, the point at which the lateral ends of receiver 5 meet fuser roller 3 is periodically changed thereby reducing the chance of fuser roller 3 swelling or grooving near the location of the lateral ends of receiver 5.

To prevent excessive lateral travel, which would result in fuser station 1 not being positioned to accept receiver 5, as it is conveyed to fusing station 1 by transport rollers 26, the lateral travel of fuser station 1 is limited, by reversing sensors, not shown, but known in the art, connected to lead screw 13. Upon nut 12 of bracket 11 making contact with a reversing sensor, the reversing sensor signals for motor 14 to be de-activated and its rotation reversed. Upon re-activation, of motor 14, the sliding movement of fusing station 1 will be opposite to its previous sliding movement thereby maintaining fusing station 1 in a position to receive receiver 5.

In operation, as an operator places an original document on the reproduction apparatus and selects the amount of copies to be made and the size of receiver to be used, depending on whether logic and control system 17 is a smart system, this information is either conveyed to logic and control circuit 17 for comparison purposes or for tallying the copies that have been made since the last lateral movement of fusing station 1. If either the comparison or the tally indicates fusing station 1 should be laterally moved to prevent possible swelling or grooving of fuser roller 3, logic and control circuit 17 activates motor 14 to laterally move fusing station 1 a pre-determined amount. Once the lateral movement is completed, receiver 5 is processed by the reproduction apparatus and sent, to the now stationary fusing station 1 for fusing. The fusing of receiver 5, however, now takes place in a different area, as shown by the representation of receiver 5 in dotted lines in FIG. 1, of fusing station 1 than the place receiver 5 had been previously fused, as shown by the representation of receiver 5 in solid lines in FIG. 1. This minimizes the swelling or grooving of fuser roller 3 in the location of the lateral edges of receiver 5.

While the invention has been described in detail with particular reference to a preferred embodiment thereof, it will be understood that variations and modifications can be effected within the spirit and scope of the invention as described hereinabove and as defined in the appended claims.

I claim:

1. Reproduction apparatus for forming images on a variable number of receivers having a variable size, said apparatus comprising:

a fusing station for fusing a toner image to a receiver as the receiver moves through a nip formed by rotating rollers, the fusing station including means for mounting the rollers in rotational and pressure contact with each other and for lateral movement relative to the movement of the receiver through the nip; and drive means for imparting lateral movement to the rollers; and logic and control including means for inputting at least one of the size of the receiver to be fused and the number of receivers to be fused; and means for activating the drive means in response to an inputted size or number.

* * * * *